US007405705B2

(12) United States Patent
Fukuchi

(10) Patent No.: US 7,405,705 B2
(45) Date of Patent: Jul. 29, 2008

(54) WIDEBAND ANTENNA

(75) Inventor: Keisuke Fukuchi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/812,929

(22) Filed: Jun. 22, 2007

(65) Prior Publication Data

US 2007/0247384 A1 Oct. 25, 2007

Related U.S. Application Data

(62) Division of application No. 11/444,538, filed on Jun. 1, 2006.

(30) Foreign Application Priority Data

Aug. 31, 2005 (JP) ..... 2005-252142

(51) Int. Cl.
*H01Q 1/24* (2006.01)

(52) U.S. Cl. ..... 343/702; 343/767

(58) Field of Classification Search ..... 343/767, 343/768, 700 MS, 795, 702, 770
See application file for complete search history.

(56) References Cited

U.S. PATENT DOCUMENTS 6,914,573 B1 * 7/2005 McCorkle ..... 343/767
7,268,741 B2 * 9/2007 Sarabandi et al. ..... 343/866
2005/0151694 A1 * 7/2005 Huang ..... 343/767

FOREIGN PATENT DOCUMENTS

JP 2004-343424 A 12/2004
JP 2005-094437 A 4/2005
JP 2005-094499 A 4/2005

OTHER PUBLICATIONS

Chang et al., *Microwave and Optical Technology Letters*, vol. 25, No. 3, May 5, 2000, pp. 206-211.

* cited by examiner

*Primary Examiner*—HoangAnh T Le
(74) *Attorney, Agent, or Firm*—Foley & Lardner LLP

(57) ABSTRACT

A wideband antenna has: a rectangular conductor sheet; a bow-tie-shaped slit formed in the rectangular conductor sheet, the rectangular conductor sheet having two apex portions defined by the bow-tie-shaped slit, the two apex portions being opposite to each other in the middle of the bow-tie-shaped slit; an auxiliary antenna element formed to extend along the bow-tie-shaped slit on both sides of one of the two apex portions; a power-feeding portion formed at the one of the two apex portions; and a grounding portion formed at an other of the two apex portions.

5 Claims, 5 Drawing Sheets

WIDEBAND ANTENNA

The present application is a divisional of U.S. application Ser. No. 11/444,538, filed Jun. 1, 2006, the entire contents of which are incorporated herein by reference.

The present application is based on Japanese patent application No. 2005-252142, the entire contents of which are incorporated herein by reference.

BACKGROUND OF THE INVENTION

1. Field of the Invention

The present invention relates to a wideband antenna, and particularly to a wideband antenna, such as a UWB antenna, capable of being applied to UWB (Ultra Wide Band) communications equipment for next-generation ultrahigh-speed communications.

2. Description of the Related Art

UWBs (Ultra Wide Bands) are wireless and capable of more high-speed communications than optical fiber communications, and is expected as a communications means to replace bluetooth™, which uses 2.4 GHz band, and wireless LANs, which use existing 5 GHz band (IEEE 802.11a), etc.

UWBs are a communications method, which uses wideband and multiband frequencies from 3.1 GHz to 10.6 GHz, to realize 100 M to 1 G/bps high-speed data communications, which requires hitherto nonexistent wide bands of antennas used therein.

It has been substantially determined that 3-5 GHz band is used in the current first UWB communications. Further, it is desired that 2.3-6 GHz band is covered in the case of its use combined with wireless LANs, etc.

As conventional UWB antennas, there are suggested various antennas, such as an antenna with a home-base-shaped conductor sandwiched between dielectrics, and whose baseball-shaped apex is grounded with a power supply sandwiched therebetween (see JP-A-2005-94437); an improved Sierpinski antenna (see JP-A-2004-343424); an improved patch antenna (see JP-A-2005-94499), etc.

However, no wideband antenna has been able to be realized that is small and thin, but which covers the wide band of 2.3-6 GHz, and which is in a relative bandwidth of 50% or more.

SUMMARY OF THE INVENTION

Accordingly, it is an object of the present invention to provide a wideband antenna which is small and thin, but which covers a wide band of frequencies, and which is in a relative bandwidth of 50% or more.

(1) According to one aspect of the invention, a wideband antenna comprises:

a rectangular conductor sheet;

a bow-tie-shaped slit formed in the rectangular conductor sheet, the rectangular conductor sheet comprising two apex portions defined by the bow-tie-shaped slit, the two apex portions being opposite to each other in the middle of the bow-tie-shaped slit;

an auxiliary antenna element formed to extend along the bow-tie-shaped slit on both sides of one of the two apex portions;

a power-feeding portion formed at the one of the two apex portions; and a grounding portion formed at an other of the two apex portions.

In the above invention (1), the following modifications and changes can be made.

(a) The bow-tie-shaped slit is formed in a shape comprising laterally joined-two rhombuses, laterally joined-two triangles, or a lateral 8-shape.

(b) The bow-tie-shaped slit comprises a length to be resonant at low frequencies in a wavelength band for transmission/reception, and the auxiliary antenna element comprises two elements each comprising a length to be resonant at high frequencies in a wavelength band for transmission/reception.

(c) The rectangular conductor sheet, the bow-tie-shaped slit and the auxiliary antenna element are formed simultaneously by stamping a metal sheet.

(2) According to another aspect of the invention, a wideband antenna comprises:

a rectangular conductor sheet;

an odd-shaped slit with a laterally elongated rhombic or tapered shape formed in the rectangular conductor sheet so that a notch slit is formed to extend from side-corner portions of the odd-shaped slit toward the long sides of the rectangular conductor sheet;

an auxiliary antenna element formed to extend from one side-corner portion of the side-corner portions into the odd-shaped slit;

a power-feeding portion formed at the base of the auxiliary antenna element; and a grounding portion formed in the other side-corner portion of the mutually opposite side-corner portions of the notch slit.

In the above invention (2), the following modifications and changes can be made.

(d) The odd-shaped slit with a laterally elongated rhombic or tapered shape is formed to be positioned on the upper side of the rectangular conductor sheet, and a grounding piece is formed on the lower side of the rectangular conductor sheet to the odd-shaped slit.

ADVANTAGES OF THE INVENTION

The wideband antenna according to the present invention is capable of realizing a wideband antenna which is small and thin, but which covers the frequency band of 2.3-6 GHz, and which is in a relative bandwidth of 50% or more.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
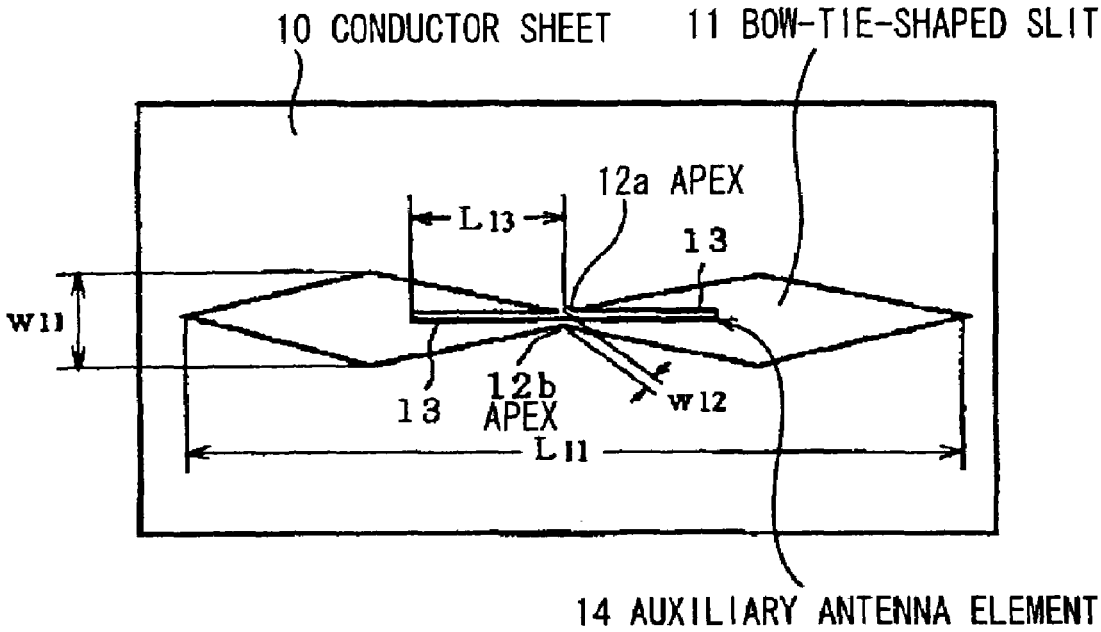
FIG. 1 is a diagram showing a wideband antenna according to a first embodiment of the present invention.
Figure 2:
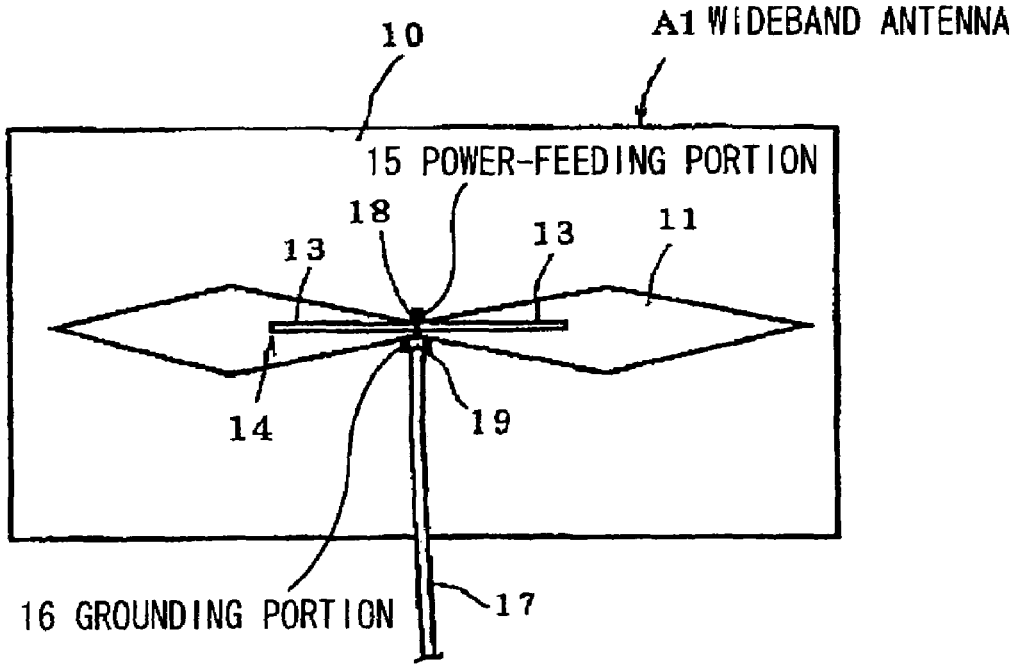
FIG. 2 is a diagram showing the wideband antenna of FIG. 1 with a coaxial cable connected thereto.

FIG. 1 shows a wideband antenna formed of a metal sheet stamped out with a press according to a first embodiment of the present invention. FIG. 2 shows the wideband antenna A1 of FIG. 1 with a coaxial cable connected thereto.

In FIGS. 1 and 2, a 0.1-0.5 mm thick metal sheet is stamped out with a press to form a rectangular conductor sheet 10. The rectangular conductor sheet 10 is stamped out with a press to form a bow-tie-shaped slit 11 therein.

The rectangular conductor sheet 10 is formed in a 80 mm wide and 40 mm long rectangular shape. The bow-tie-shaped slit 11 is formed in a two laterally joined rhombic shape.

On both sides of one apex portion 12*a* of apex portions 12*a* and 12*b* opposite each other in the middle of the bow-tie-shaped slit 11, there are formed radiating elements 13 and 13 which extend along the bow-tie-shaped slit 11 to make up an auxiliary antenna element 14.

In the apex portion 12*a* on the auxiliary antenna element 14 side is formed a power-feeding portion 15, and in the other apex portion 12*b* a grounding portion 16. As shown in FIG. 2, a power-feeding line 18 on the inner side of a coaxial cable 17 is soldered to the power-feeding portion 15, and an outer conductor 19 on the outer side thereof to the grounding portion 16.

Length L11 of the bow-tie-shaped slit 11 is formed to be resonant at low frequencies in a wavelength band for transmission/reception. For example, the slit length L11 is formed to be 76 mm, maximum width w11 9 mm, and width w12 between the middle apex portions 12*a* and 12*b* 2 mm.

Also, length L13 of the radiating elements 13 and 13 of the auxiliary antenna element 14 is formed to be resonant at high frequencies in a wavelength band for transmission/reception, i.e., to be generally ¼ wavelength at high frequencies. In this embodiment, the length L13 is formed to be ¼ of 50 mm wavelength at 6 GHz, i.e., 12.5 mm.

The electric field formed in the bow-tie-shaped slit 11 allows the wideband antenna A1 shown in FIGS. 1 and 2 to be resonant at low frequencies, while allowing the auxiliary antenna element 14 to be resonant at high frequencies.

This bow-tie-shaped slit 11 allows a targeted wide band to be ensured by choosing resonant frequency values for the slit antenna and the auxiliary antenna element 14 to be mutually different and complementary.

Figure 3A:
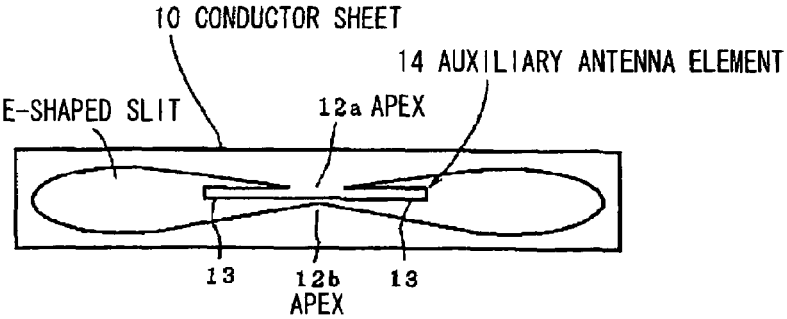
FIG. 3A is respectively a diagram showing a wideband antenna according to a second embodiment of the present invention, and FIG. 3B a diagram showing the wideband antenna of FIG. 3A with a coaxial cable connected thereto.
Figure 3B:
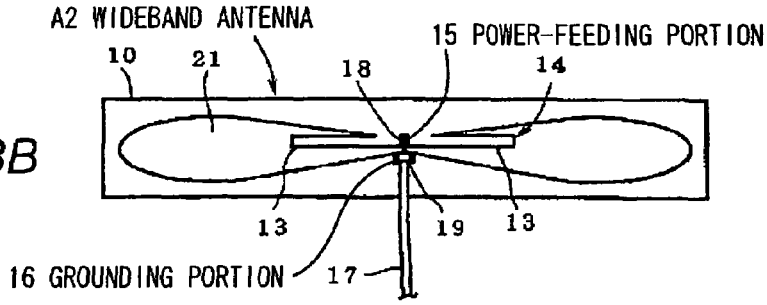

FIG. 3A is a diagram showing a wideband antenna according to a second embodiment of the present invention, and FIG. 3B a diagram showing the wideband antenna of FIG. 3A with a coaxial cable connected thereto.

A wideband antenna A2 of this embodiment has a laterally elongated 8-shaped bow-tie-shaped slit 21 formed in a conductor sheet 10, and the other configuration is basically the same as that of FIGS. 1 and 2. Specifically, a 0.1-0.5 mm thick metal sheet is stamped out with a press to form a rectangular conductor sheet 10. In the rectangular conductor sheet 10 is formed the laterally elongated 8-shaped bow-tie-shaped slit 21. On both sides of one apex portion 12*a* of apex portions 12*a* and 12*b* opposite each other in the middle of the bow-tie-shaped slit 21, there are formed radiating elements 13 and 13 which extend along the bow-tie-shaped slit 21 to make up an auxiliary antenna element 14.

In the apex portion 12*a* on the auxiliary antenna element 14 side is formed a power-feeding portion 15, and in the other apex portion 12*b* a grounding portion 16. As shown in FIG. 3B, a power-feeding line 18 on the inner side of a coaxial cable 17 is soldered to the power-feeding portion 15, and an outer conductor 19 on the outer side thereof to the grounding portion 16.

Since this laterally elongated 8-shaped bow-tie-shaped slit 21 is formed curvedly, the electric field distribution is smooth on the boundary between the space and the metal of the slit 21, and adjustment of the resonant band targeted to low frequencies is facilitated by adjusting the curvature of the slit 21.

Figure 4:
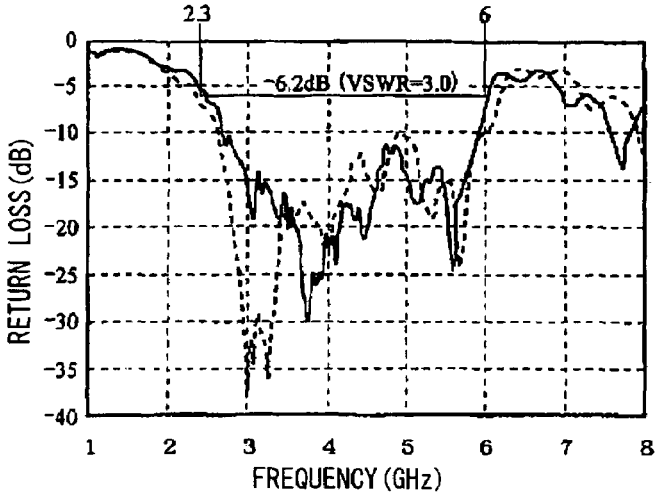
FIG. 4 is a diagram showing characteristics of the wideband antennas of FIGS. 1 and 2, and of FIGS. 3A and 3B.

FIG. 4 shows the results of measuring return loss of the wideband antenna A1 shown in FIGS. 1 and 2, and of the wideband antenna A2 shown in FIGS. 3A and 3B, in which solid line a denotes the characteristic of the wideband antenna shown in FIGS. 1 and 2, and broken line b denotes the characteristic of the wideband antenna shown in FIGS. 3A and 3B.

From FIG. 4, it is found that both the antennas A1 and A2 have the band of 2.3-6 GHz at return losses of −6.2 dB or less (VSWR=3.0 or less), which are the indication for indicating antenna's sufficient resonance.

It is found that the relative bandwidth (=bandwidth/center frequency), which is the indication for indicating the width of a band, is as very wideband as 89%, and that 2.3-6 GHz oscillation is realizable.

This means that the antennas are realizable that are capable of covering 3 bands of IEEE802.11b/g (2.4-2.5 GHz), UWB (3-5 GHz), and IEEE802.11a (4.9-5.9 GHz).

Although the bow-tie-shaped slits 11 and 21 are respectively shown as formed in the two laterally joined rhombic shape and the laterally elongated 8-shape, their shapes may not only be modified appropriately according to low resonant frequency bands, but the length of the auxiliary antenna element 14 may also be modified appropriately according to high resonant frequency bands. Also, for good electrical connection of the grounding portion 16 to a metallic chassis for installation, a contact portion for contacting the metallic chassis may be provided in the conductor sheet 10 on the grounding portion side, so that the metallic chassis may be utilized as antenna ground, which can thereby result in a small-size and high-performance antenna.

Figure 5:
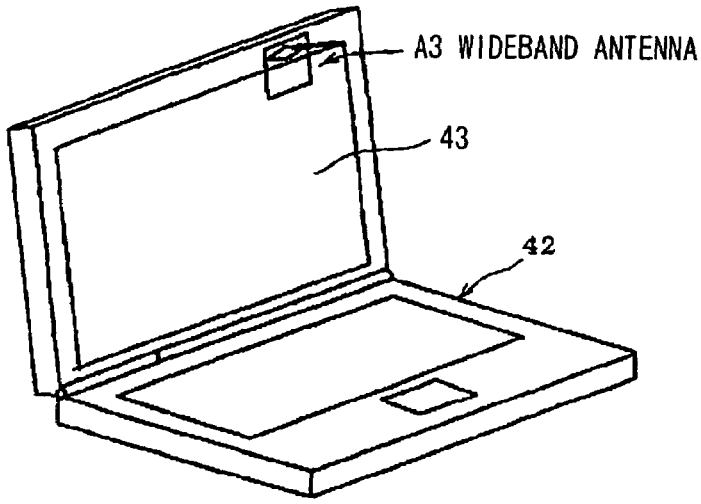
FIG. 5 is a diagram showing an example of mounting a wideband antenna shown in FIG. 6B to a notebook PC.
Figure 6A:
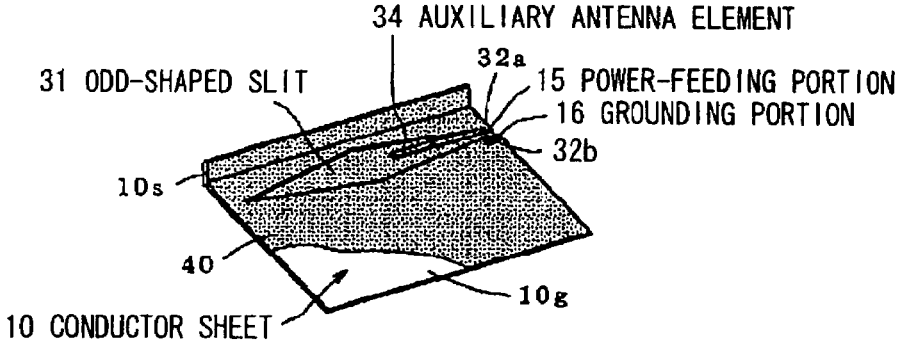
FIGS. 6A and 6B are diagrams showing wideband antennas formed by cutting the wideband antennas of FIGS. 1 and 2, respectively, in the middle portion of the bow-tie-shaped slit thereof, according to a third embodiment of the present invention.
Figure 6B:
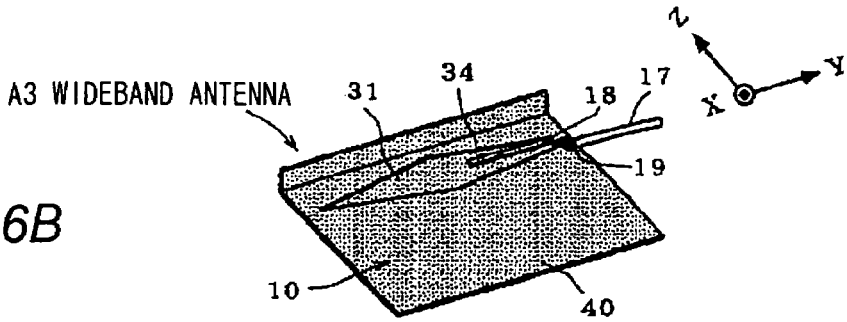

FIG. 5, FIGS. 6A and 6B show a third embodiment of the present invention.

Although in the above-described embodiments, the bow-tie-shaped slits 11 and 21 are formed in the conductor sheet 10, and the coaxial cable 17 is connected in the middle of the bow-tie-shaped slits 11 and 21, to obtain resonance at low frequencies, the bow-tie-shaped slits 11 and 21 need to be substantially 70 mm long, and as shown in FIG. 5, installation of antenna A3 in a notebook PC 42, etc. requires further size reduction.

Accordingly, in this embodiment, the wideband antennas A1 shown in FIGS. 1 and 2 are cut in the middle portion of the bow-tie-shaped slit 11 thereof, to form wideband antennas A3, as shown in FIGS. 6A and 6B respectively.

Specifically, as shown in FIG. 6A, a metal sheet made of a copper alloy is stamped out with a press to form a rectangular conductor sheet 10 (40 mm wide and 30 mm long, for example) In the rectangular conductor sheet 10 is formed an odd-shaped slit 31 (38 mm wide and 10 mm long) with a laterally elongated rhombic shape so that a notch slit 33 is formed to extend from side-corner portions 32*a* and 32*b* of the odd-shaped slit 31 toward the long sides of the rectangular conductor sheet 10. A 12 mm long auxiliary antenna element 34 is formed to extend from one side-corner portion 32*a* of the mutually opposite side-corner portions 32*a* and 32*b* of the notch slit 33, into the odd-shaped slit 31. A power-feeding portion 15 is formed at the base (in one side-corner portion 32*a*) of the auxiliary antenna element 34, and a grounding portion 16 is formed in the other side-corner portion 32*b* of the side-corner portions 32*a* and 32*b* opposite each other via the notch slit 33.

This odd-shaped slit 31 with a rhombic shape is formed to be positioned on the upper side of the rectangular conductor sheet 10. On the lower side of the rectangular conductor sheet 10 to the odd-shaped slit 31, there is formed a grounding piece 10*g* whose area is larger than the area of the upper side of the rectangular conductor sheet 10.

After the odd-shaped slit 31 and the auxiliary antenna element 34 are thus formed by being stamped out with a press, both sides of the conductor sheet 10 are laminated with a polyimide film 40, followed by valley fold of the upper side of the conductor sheet 10 to form an upright portion 10*s*.

Also, as shown in FIG. 6B, a coaxial cable 17 (diameter 1.13 mm, length 510 mm) is placed in the longitudinal direction of the odd-shaped slit 31. A power-feeding line 18 on the inner side of the coaxial cable 17 is soldered to the power-feeding portion 15 at the base of the auxiliary antenna element 34, and an outer conductor 19 on the outer side thereof to the grounding portion 16, which results in the wideband antenna A3.

FIG. 5 shows an example of mounting the wideband antenna A3 of FIG. 6B to a notebook PC 42, where the antenna A3 is installed between the backside and cover of display 43.

Figure 7A:
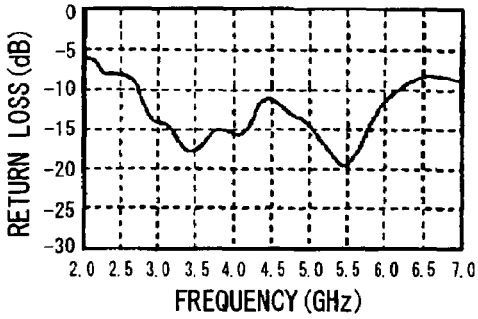
FIGS. 7A and 7B are diagrams showing return loss versus frequency characteristics and voltage standing wave ratio (VSWR) versus frequency characteristics, respectively, of the wideband antenna of FIG. 6B.
Figure 7B:
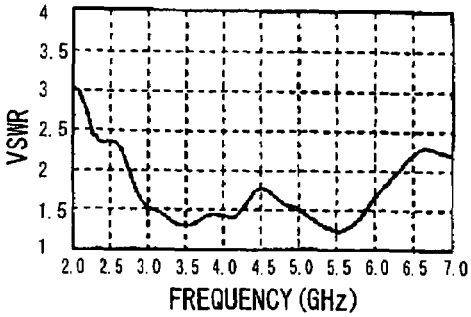

FIGS. 7A and 7B show return loss versus frequency characteristics and voltage standing wave ratio (VSWR) versus frequency characteristics, respectively, of the wideband antenna A3 of FIG. 6B.

Figures 8A, 8B, 8C:
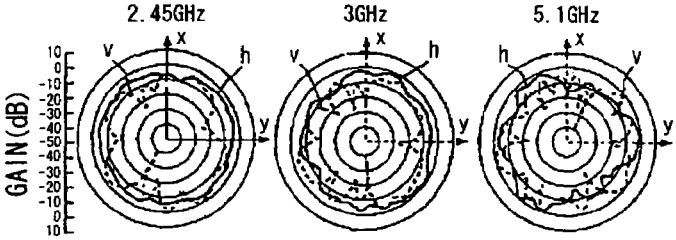
FIGS. 8A-8C are diagrams showing radiation patterns in the xy-plane for frequencies of 2.45 GHZ, 3 GHz, and 5.1 GHz, respectively, of the wideband antenna of FIG. 6B.

As shown in FIGS. 7A and 7B, the wideband antennas are realizable that have the band of 2.3-6 GHz at return losses of −7.36 dB or less (VSWR=2.5 or less), FIGS. 8A-8C show radiation patterns in the xy-plane for frequencies of 2.45 GHz, 3 GHz, and 5.1 GHz, respectively, of the wideband antenna A3 in the xyz-coordinates as shown in FIG. 6B, where solid line h denotes a horizontally-polarized wave, and broken line v a vertically-polarized wave.

As shown in FIGS. 8A-8C, it is found that the antenna A3 is nondirectional for 2.45 GHz, 3 GHz, and 5.1 GHz, but its gain is high at each frequency thereof.

Figure 9A:
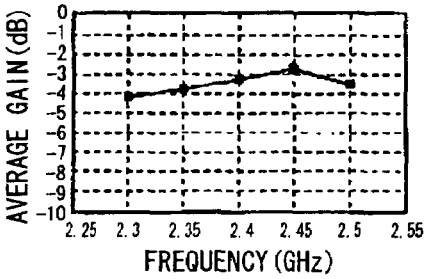
FIGS. 9A and 9B are diagrams showing average gains for frequency bands of 2.3-2.5 GHz and 3-6 GHz, respectively, of the wideband antenna of FIG. 6B.
Figure 9B:
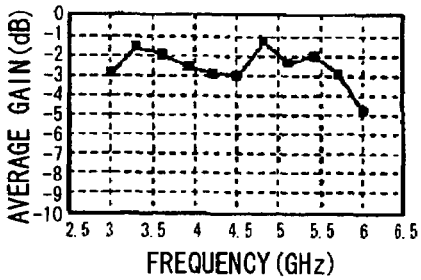

FIGS. 9A and 9B show average gains for 2.3-2.5 GHz band and 3-6 GHz band, respectively.

From FIGS. 9A and 9B, it is found that the antenna A3 has been able to be realized that is flat over the wideband and has the high gain.

Figure 10:
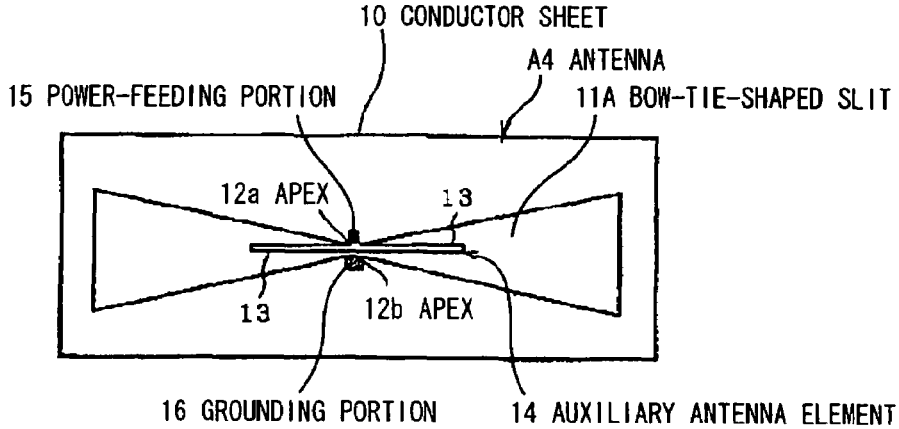
FIG. 10 is a diagram showing a wideband antenna according to a fourth embodiment of the present invention.
Figure 11:
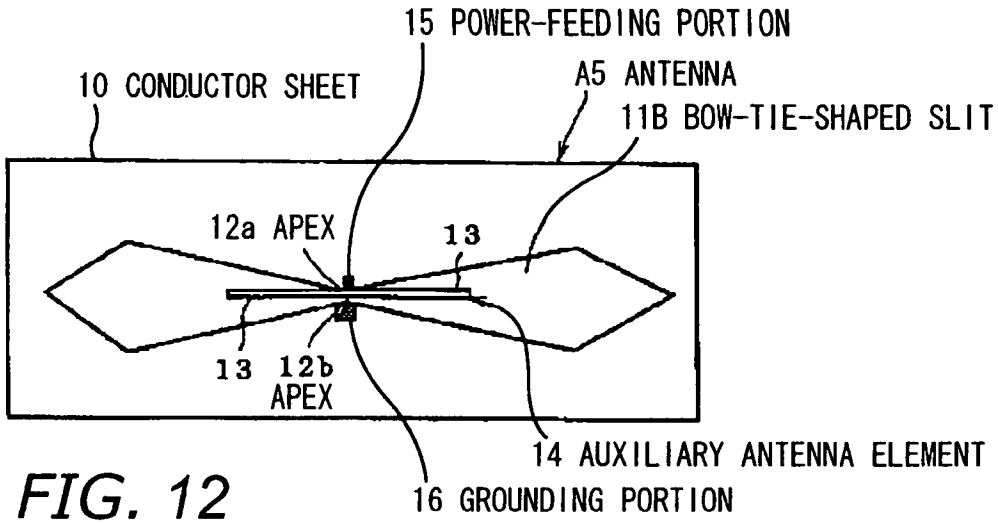
FIG. 11 is a diagram showing a wideband antenna according to a fifth embodiment of the present invention.

FIGS. 10 and 11 show wideband antennas according to fourth and fifth embodiments, respectively, of the present invention, which show modified examples of the antennas A1 and A2 of FIGS. 1 and 3. Specifically, FIG. 10 shows an antenna A4 with a bow-tie-shaped slit 11A formed in a conductor sheet 10, in which the bow-tie-shaped slit 11A is constructed by laterally joining together the apexes of isosceles triangular (tapered) shapes in such a manner as to face each other. FIG. 11 shows an antenna A5 with a bow-tie-shaped slit 11B formed in a conductor sheet 10, in which the bow-tie-shaped slit 11B is constructed by laterally joining together the bases of necktie shapes in such a manner as to face each other.

The wideband antennas of FIGS. 10 and 11 have the modified shapes of the bow-tie-shaped slits 11A and 11B respectively to modify the electric field distribution between the slits, which thereby allows antenna design according to wavelengths desired to be resonant at low frequencies.

Figure 12:
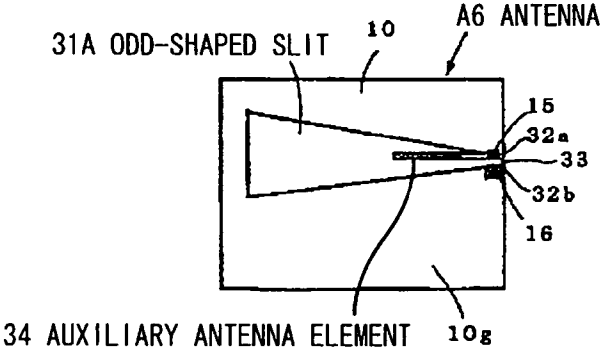
FIG. 12 is a diagram showing a wideband antenna according to a sixth embodiment of the present invention.

FIG. 12 show a wideband antenna A6 according to a sixth embodiment of the present invention, which shows a modified example of the antenna A3 of FIG. 6. Specifically, this antenna A6 has an odd-shaped slit 31A with a laterally elongated triangular shape instead of the laterally elongated rhombic shape shown in FIG. 6.

This antenna A6 with the odd-shaped slit 31A in a laterally elongated triangular shape also modifies the electric field distribution, which thereby allows modifying resonant wavelengths at low frequencies.

As described above, the wideband antenna of the present invention is realized so as to be resonant at the 2.3-6 GHz band in the relative bandwidth of 50%.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A wideband antenna, comprising:

a rectangular conductor sheet;

an odd-shaped slit with a laterally elongated rhombic or tapered shape formed in the rectangular conductor sheet so that a notch slit is formed to extend from side-corner portions of the odd-shaped slit toward the long sides of the rectangular conductor sheet;

an auxiliary antenna element formed to extend from one side-corner portion of the side-corner portions into the odd-shaped slit;

a power-feeding portion formed at a base of the auxiliary antenna element; and a grounding portion formed in the other side-corner portion of the mutually opposite side-corner portions of the notch slit.

2. The wideband antenna according to claim 1, wherein:

the odd-shaped slit with a laterally elongated rhombic or tapered shape is formed to be positioned on the upper side of the rectangular conductor sheet, and a grounding portion is formed on the lower side of the rectangular conductor sheet to the odd-shaped slit.

3. The wideband antenna according to claim 1, wherein:

the power-feeding portion is electrically connected to the rectangular conductor sheet.

4. The wideband antenna according to claim 1, wherein:

the power-feeding portion is formed at the one side-corner portion.

5. The wideband antenna according to claim 1, wherein the auxiliary antenna element has a rectangular shape.

* * * * *